US005683201A

United States Patent [19]

Guaron

[11] Patent Number: 5,683,201

[45] Date of Patent: Nov. 4, 1997

[54] SPRING-BIASED LATCH

[75] Inventor: Jacques P. Guaron, Issaquah, Wash.

[73] Assignee: Advanced Engineered Products, Inc., Issaquah, Wash.

[21] Appl. No.: 556,127

[22] Filed: Nov. 9, 1995

[51] Int. Cl.[6] ..... B25G 3/18

[52] U.S. Cl. ..... 403/325; 403/321; 403/327; 403/373; 292/210; 292/226; 280/250.1; 297/440.2

[58] Field of Search ..... 403/49, 321, 325, 403/326, 327, 373, 374, 390, 397; 297/440.2, 440.21, 440.22; 280/250.1, 647, 650, 651, 657, 658; 292/226, 209, 210; 24/327, 330, 334

[56] References Cited

U.S. PATENT DOCUMENTS

| | | | |
|---|---|---|---|
| 1,345,785 | 7/1920 | Koch | 292/210 X |
| 2,476,268 | 7/1949 | Beck et al. | 292/210 X |
| 3,700,282 | 10/1972 | Rowland | 297/440 X |
| 3,989,300 | 11/1976 | Heumann | 297/440.2 X |
| 4,475,752 | 10/1984 | McKenna | 292/210 |
| 4,493,488 | 1/1985 | Panaia et al. | 297/440 X |
| 4,629,246 | 12/1986 | Fulton | 297/440 X |
| 4,898,425 | 2/1990 | Mundy | 297/440 X |
| 4,932,694 | 6/1990 | Cater, Sr. | 292/210 |
| 4,981,390 | 1/1991 | Cramer, Jr. et al. | 403/371 |
| 5,062,677 | 11/1991 | Jay et al. | 297/440 X |
| 5,118,215 | 6/1992 | Freier | 403/344 X |
| 5,127,709 | 7/1992 | Rubinstein et al. | 297/440.2 |
| 5,221,154 | 6/1993 | Foulquier et al. | 403/322 X |
| 5,440,905 | 8/1995 | Yamada | 292/DIG. 31 |
| 5,465,462 | 11/1995 | Yamada | 292/DIG. 31 |
| 5,518,040 | 5/1996 | Rupflin | 403/325 X |

FOREIGN PATENT DOCUMENTS

| | | | |
|---|---|---|---|
| 45404 | 4/1954 | France | 24/334 |

*Primary Examiner*—Kenneth J. Dorner
*Assistant Examiner*—Bruce A. Lev
*Attorney, Agent, or Firm*—Christensen O'Connor Johnson & Kindness PLLC

[57] ABSTRACT

A spring-biased latch is disclosed for removably attaching a first component, such as a seat, to an elongate member, such as the tubular frame of a wheelchair. The spring-biased latch comprises a body portion having a top and a pair of leg members that are adapted to removably receive an elongate member, a catch arm pivotally attached to the top of the body portion, and a release lever pivotally attached to the top of the body portion. The catch arm and release lever are configurable in a first position where the inboard end of the release lever abuts the inboard end of the catch arm such that the catch arm braces a portion of the wheelchair seat between the outboard end of the catch arm and the tubular frame of the wheelchair. The catch arm and release lever are also configurable in a second position where application of force to the outboard end of the release lever pivots the inboard end of the release lever away from the inboard end of the catch arm such that the catch arm pivots away from the wheelchair seat so that the catch arm does not brace a portion of the wheelchair seat between the outboard end of the catch arm and the tubular frame of the wheelchair.

14 Claims, 3 Drawing Sheets

SPRING-BIASED LATCH

BACKGROUND OF THE INVENTION

The present invention applies to latches, and more specifically, spring-biased latches for removably attaching a first component, such as a seat, to an elongate member, such as a tubular frame of a wheelchair or the like.

The removal of seats from wheelchairs is often necessary for the breakdown of the wheelchair for storage or transportation, for cleaning of the wheelchair seat and other portions of the wheelchair, or for replacement of the currently used wheelchair seat with a different wheelchair seat. The use of traditional bolts, screws or nuts to attach the wheelchair seat to the wheelchair does not provide quick, convenient release. Instead, tools are often required to loosen these attachment mechanisms; and wheelchair-bound individuals often suffer from health problems which have compromised their strength and movement ability, thus making the removal of these attachment devices even more difficult. Furthermore, the above prior art attachment devices have exposed, sharp ends, edges and corners which can injure, or at least render uncomfortable, the wheelchair user.

A need thus exists for a spring-biased latch for a wheelchair which securely holds the wheelchair seat on the wheelchair frame with a catch arm configured in a first position.

A need exists for the above type of spring-biased latch in which the catch arm is conveniently configured in a second position by the depression of a release lever to allow removal of the wheelchair seat from the wheelchair.

A need further exists for the above type of spring-biased latch in which the wheelchair seat is again attached to the wheelchair by the application of downward force onto a catch arm that braces the wheelchair seat against the frame of the wheelchair.

A further need exists for the above type of spring-biased latch that has a low profile lacking sharp protrusions when the catch arm braces the wheelchair seat against the frame of the wheelchair.

SUMMARY OF THE INVENTION

A spring-biased latch is disclosed for removably attaching a first component, such as a seat, to an elongate member, such as the tubular frame of a wheelchair. The spring-biased latch comprises a body portion having a top and a pair of leg members that are adapted to removably receive an elongate member, a catch arm pivotally attached to the top of the body portion, and a release lever pivotally attached to the top of the body portion. The catch arm and release lever are configurable in a first position where the inboard end of the release lever abuts the inboard end of the catch arm such that the catch arm is parallel with the tubular frame of the wheelchair and braces a portion of the wheelchair seat between the outboard end of the catch arm and the tubular frame of the wheelchair. The catch arm and release lever are also configurable in a second position where application of force to the outboard end of the release lever pivots the inboard end of the release lever away from the inboard end of the catch arm such that the catch arm pivots away from the wheelchair seat so that the catch arm is perpendicular with the tubular frame of the wheelchair and does not brace a portion of the wheelchair seat between the outboard end of the catch arm and the tubular frame of the wheelchair. To re-secure the wheelchair seat to the tubular frame of the wheelchair, application of force to the outboard end of the catch arm pivots the catch arm and release lever so that the inboard end of the release lever abuts the inboard end of the catch arm and the outboard end of the catch arm braces a portion of the wheelchair seat against the tubular frame of the wheelchair.

Preferably, the inboard end of the release lever has a concave surface matable with the convex surface on the inboard end of the catch arm when the inboard end of the catch arm abuts the inboard end of the release lever. Additionally, pivotal attachment of the catch arm to the top of the body portion includes a spring that biases the catch arm to pivot away from the wheelchair seat. Also, the pivotal attachment of the release lever to the top of the body portion includes a spring that biases the inboard end of the release lever to abut the inboard end of the catch arm. The outboard end of the catch arm most preferably has a concave underside to brace the convex surface of the hook of the wheelchair seat, and the pair of leg members of the body portion each has an interior side that is concave to mate with the tubular wheelchair frame. Finally, a shim can be located between the leg members of the body portion; the shim having a semi-circular, tapered cross-section to mate with the tubular wheelchair frame.

BRIEF DESCRIPTION OF THE DRAWINGS

The foregoing objects and attendant advantages of this invention will become more readily appreciated as the same becomes better understood by reference to the following detailed description when taken in conjunction with the accompanying drawings.

DETAILED DESCRIPTION OF THE PREFERRED EMBODIMENTS

Figure 1:
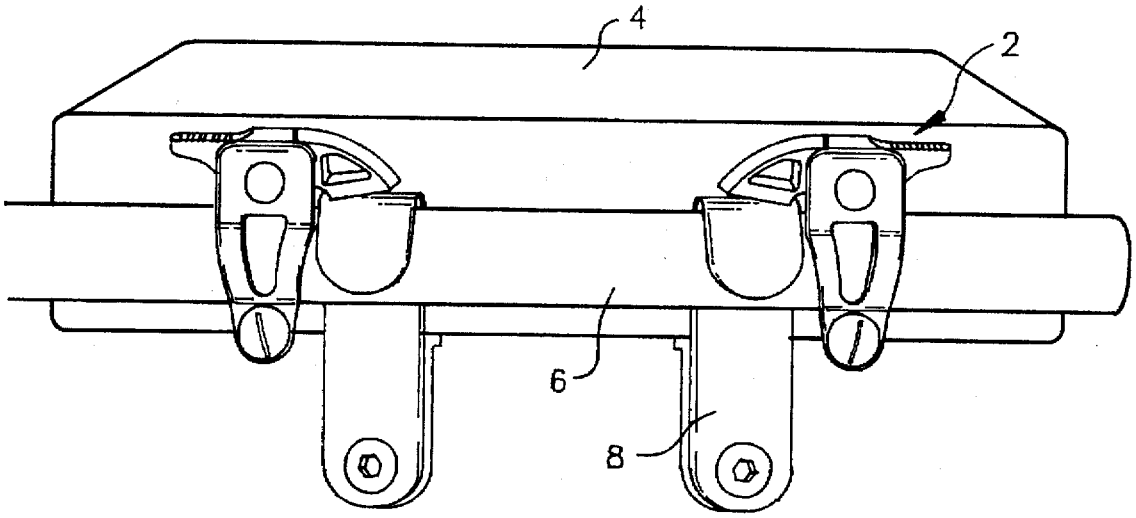
FIG. 1 is a perspective view of the spring-biased latch of the present invention in use to removably attach a wheelchair seat to a wheelchair frame.

Referring to FIGS. 1–11, and specifically to FIG. 1, the present invention is a spring-biased latch 2 adapted to removably attach, for example, a wheelchair seat 4 to wheelchair frame 6 by bracing seat hooks 8 between wheelchair frame 6 and spring-biased latch 2. While the present invention is shown in the environment of attaching wheelchair seat 4 to wheelchair frame 6, it is understood that the present invention is applicable to the attachment of any component to a tubular member to which spring-biased latch 2 can be attached.

Now referring specifically to FIGS. 1–4, spring-biased latch 2 of the present invention is more specifically described. Spring-biased latch 2 is comprised of body portion 10 adapted top 12 and legs 14 and 16. Legs 14 and 16 are adapted to removably receive, for example, wheelchair frame 6 or another tubular member, therein. More specifically, legs 14 and 16 include concave interior surfaces 18 and 20, respectively, which mate with an elongate member such as a tubular segment having a circular cross-section, for example, wheelchair frame 6. Lower portions 22 and 24, respectively, of leg 14 and leg 16 are angled with respect to the longitudinal axis of spring-biased latch 2 such that a narrowing channel 26 is formed which allows legs 14 and 16 to straddle an elongate member such as wheelchair frame 6 with wheelchair frame 6 being snap-fit between legs 14 and 16 after passing through narrowing channel 26. It is readily apparent that spring-biased latch 2 is preferably comprised of a synthetic polymer well-known in the art having sufficient resilience to allow legs 14 and 16 to first spread outwardly and then return to their original configuration after receiving wheelchair frame 6. After wheelchair frame 6 or the like is secured between legs 14 and 16 of spring-biased latch 2, male screw 28 and female screw 30 are attached through screw holes 32 and tightened such that legs 14 and 16 may be deformed inwardly to more tightly contort to the shape of the external surface of wheelchair frame 6 or the like. Groove 34 is located where body portion 10 connects legs 14 and 16. Groove 34 accommodates the passage of spring-biased latch 2 over screws, bolts or the like protruding from the top portion of wheelchair frame 6 when spring-biased latch 2 is attached to wheelchair frame 6.

Figure 2:
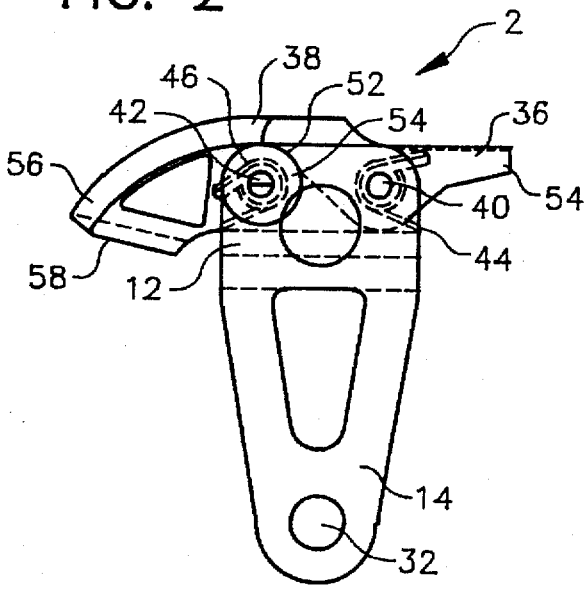
FIG. 2 is a plan view of the spring-biased latch of the present invention showing the lever arm pivoted downwardly to brace the wheelchair seat against the wheelchair frame.
Figure 3:
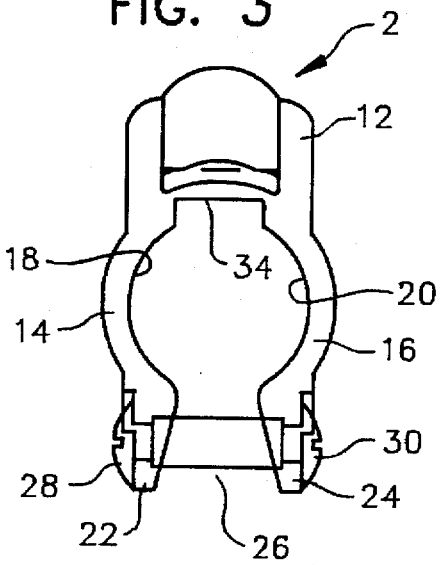
FIG. 3 is an end view taken from the rear of the spring-biased latch of the present invention.
Figure 5:
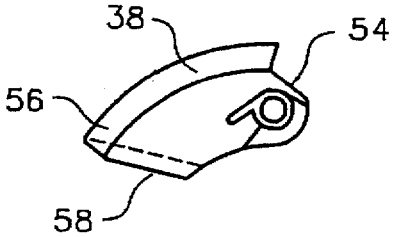
FIG. 5 is a detailed perspective view of the catch arm of the spring-biased latch of the invention.
Figure 6:
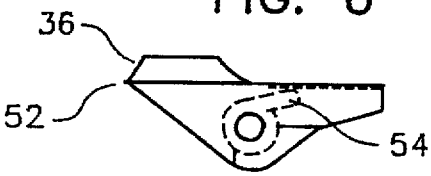
FIG. 6 is a detailed view of the release lever of the spring-biased latch of the present invention.
Figure 4:
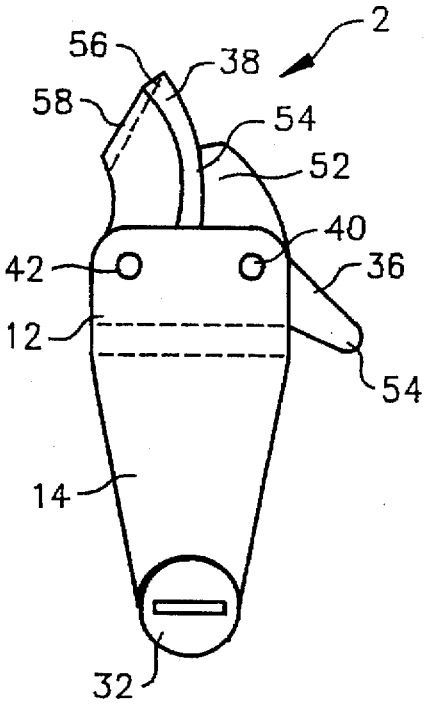
FIG. 4 is another plan view of the spring-biased latch of the present invention showing the lever arm pivoted upwardly to allow removal of the wheelchair seat from the wheelchair frame.

Referring to FIGS. 2, 4, 5 and 6, top 12 of body portion 10 houses release lever 36 and catch arm 38. Release lever 36 is pivotally attached to body portion 10 by axle 40 and catch arm 38 is pivotally attached to top 12 of body portion 40 by axle 42. Spring 44 which is wound around axle 1O, biases release lever 36 downwardly toward body portion 10 such that the configuration of release lever 36 as shown in FIG. 2 is the biased configuration of release lever 36, with the longitudinal axis of release lever 36 being substantially perpendicular to the longitudinal axes of legs 14 and 16. In contrast, spring 46, which is wound around axle 42, biases catch arm 38 upwardly away from body portion 10 such that the configuration of catch arm 38 as shown in FIG. 4 is the biased configuration of catch arm 38, with the longitudinal axis of catch arm 38 being substantially parallel to the longitudinal axes of legs 14 and 16 of body portion 10 of spring-biased latch 2. Release lever 36 has an inboard end 50 which is concave to mate with convex inboard end 54 of catch arm 38 when release lever 36 and catch arm 38 are configured in the position shown in FIG. 2 where the longitudinal axes of both release lever 36 and catch arm 38 are substantially perpendicular to the longitudinal axes of legs 14 and 16 of body portion 10. In the configuration shown in FIG. 2, it is important to note that catch arm 38, which braces wheelchair seat 4, or the like, against wheelchair frame 6, or the like, is in a locked configuration because downward force applied to catch arm 38 results in extreme minimal pivoting movement of catch arm 38 around axle 42 until catch arm 38 contacts top 12 of body portion 10. Additionally, upward force applied to catch arm 38 results in extremely minimal pivoting movement of catch arm 38 around axle 42 until the inboard end 52 of catch arm 38 contacts the inboard end 50 of release lever 36. In sum, catch arm 38 can only be released from the locked position as shown in FIG. 2 by applying downward force to outboard end 54 of release lever 36 such that release lever 36 pivots around axle 40 to the position shown in FIG. 4, whereby the spring bias of spring 46 of catch arm 38 pivots catch arm 38 to the position shown in FIG. 4 with the longitudinal axis of catch arm 38 being substantially parallel to the longitudinal axes of legs 14 and 16 of body portion 10. Thus, only when spring bias latch 2 is in the "release" position shown in FIG. 4, and not when spring bias latch 2 is in the "locked" position shown in FIG. 2, can the component being held, such as, for example, wheelchair seat 4, be released. To reattach wheelchair seat 4, for example, to wheelchair frame 6, for example, downward force is applied onto the top portion of outboard end 56 of catch arm 38 such that catch arm 38 pivots around axle 42 while release lever 36 pivots around axle 40 due to the bias of spring 44 which, as stated above, biases release lever 36 in the configuration shown in FIG. 2 with the longitudinal axis of catch arm 38 being substantially perpendicular to the longitudinal axes of legs 14 and 16 of body portion 10. Thus, the application of sufficient downward force on the top portion of outboard end 56 of catch arm 38 results in the concave inboard end 50 of release lever 36 again mating with the convex inboard end 52 of catch arm 38 such that spring-biased latch 2 is again in the "locked" position as shown in FIG. 2. It is to be noted that outboard end 56 preferably has a concave underside 58 which is matable with elements having convex surfaces, such as seat hooks 8 of wheelchair seat 4.

Figure 7:
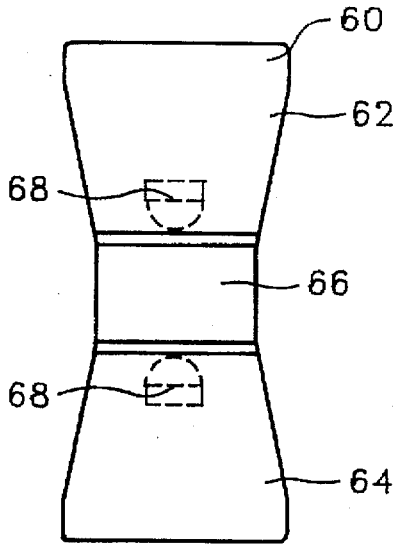
FIG. 7 is a top view of a shim usable with the spring-biased latch of the present invention.
Figure 10:
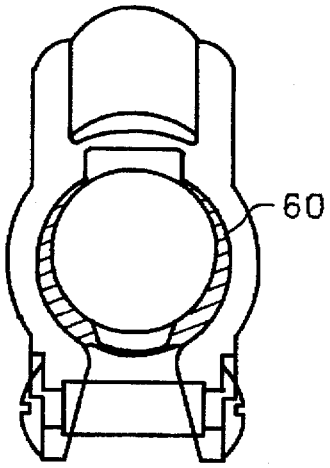
FIG. 10 is an end view showing the shim of FIG. 7 located within the spring-biased latch of the present invention for use on wheelchair frames having narrower cross-sections.
Figure 8:
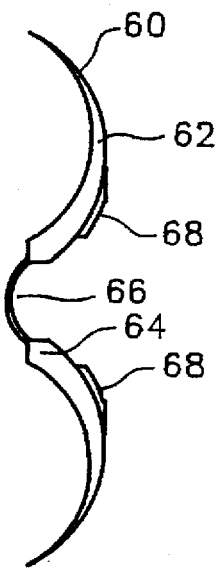
FIG. 8 is an end view of the shim of FIG. 7.
Figure 11:
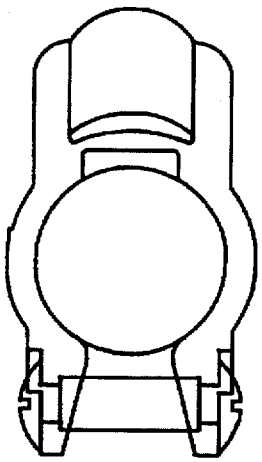
FIG. 11 is another end view of the spring-biased latch of the present invention without a shim for use on wheelchair frames having larger cross-sections.
Figure 9:
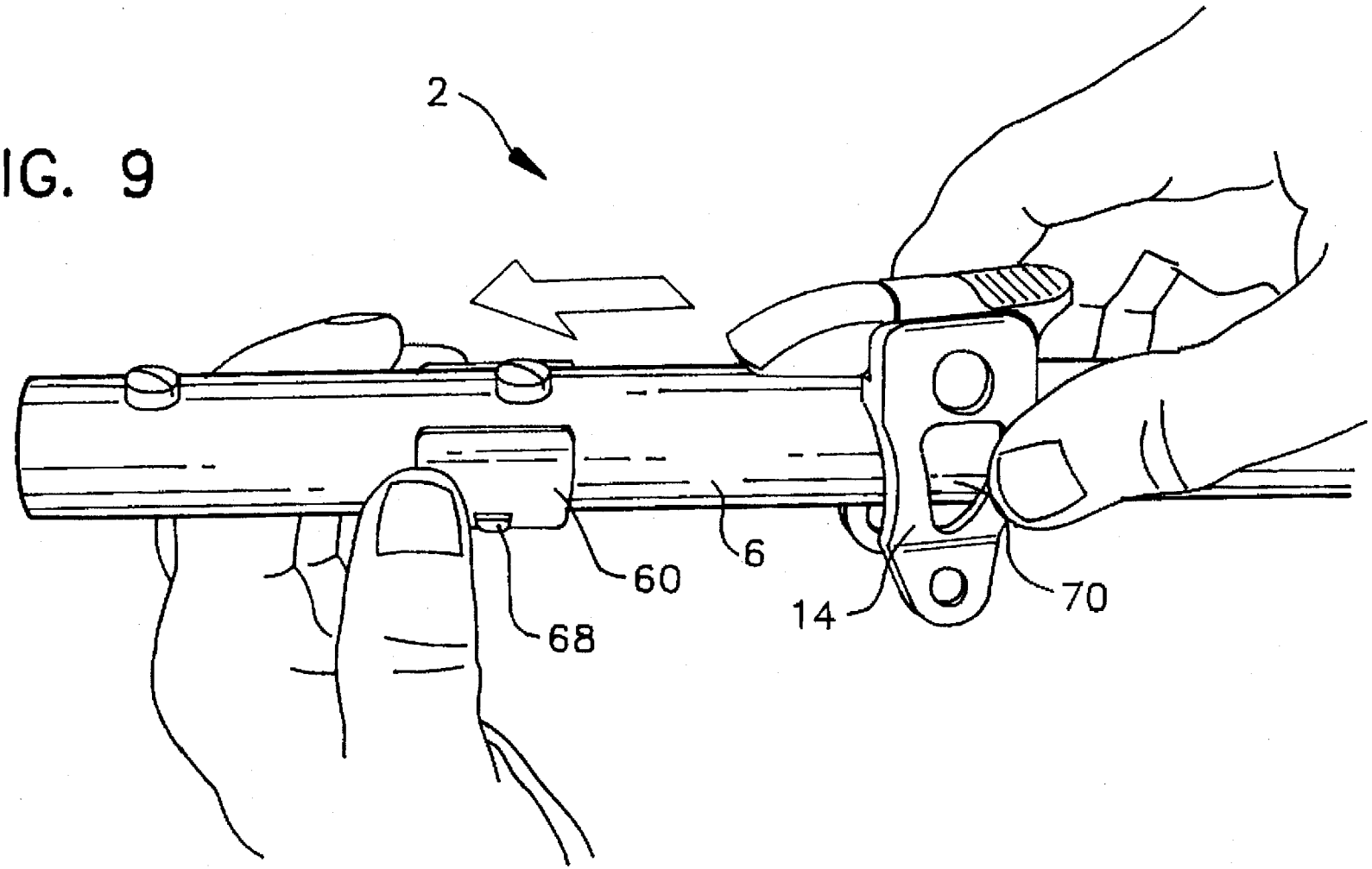
FIG. 9 is a perspective view showing the placement of the shim of FIG. 7 around a wheelchair frame and into the spring-biased latch of the present invention.

Referring specifically to FIGS. 7 through 11, shim 60, an optional element of the present invention, is described in detail. Shim 60 allows spring-biased latch 2 of the present invention to be used on tubular members, such as wheelchair frame 6, which have narrower diameters. For example, shim 60 may be employed for use on a wheelchair frame 6 that has, for example, only ⅞ of an inch diameter tubing, as shown in FIG. 10, while shim 60 is not necessary when employed on wheelchair frames 6 having tubing of one inch in diameter or more, as shown in FIG. 11. As shown in FIGS. 7 and 8, shim 60 is comprised of wings 62 and 64 joined by bridge 66, which has a narrower cross-section than the majority of either of wings 62 or 64. Each of wings 62 and 64 has a tapering cross-section that ensures that the interior of shim 60 will form a substantially circular inner diameter which is less than the inner diameter formed between legs 14 and 16 of spring-biased latch 2. The exterior surface of each of wings 62 and 64 has a tapered nub 68 thereon. As shown in FIG. 9, shim 60, being comprised on a resilient synthetic polymer, is first wrapped around wheelchair frame 6 or the like. Then, spring-biased latch 2 slides over shim 60 such that tapered nubs 68 are snap-fit within leg openings 70 of legs 14 and 16 of spring-biased latch 2. As shown in FIG. 10, shim 60, when located in spring-biased latch 2, leaves a gap which mates with groove 34 of spring-biased latch 2 in order to accommodate the passage of spring-biased latch 2 and shim 60 over protrusions on the top surface of wheelchair frame 6 or the like.

While particular embodiments of the present invention have been described in some detail herein above, changes and modifications may be made in the illustrated embodiments without departing from the spirit of the invention.

I claim:

1. An apparatus for removably attaching a first component to a second component, said apparatus comprising:

a body portion having a top and a base, said base adapted to removably attach to the second component;

a catch arm pivotally attached to said top of said body portion and having an inboard end and an outboard end, a release lever pivotally attached to said top of said body portion and having an inboard end and an outboard end, said catch arm and said release lever configurable in a first position where said inboard end of said release lever abuts said inboard end of said catch arm such that said catch arm braces a portion of the first component between said outboard end of said catch arm and the second component, said catch arm and said release lever further configurable in a second position where application of force to said outboard end of said release lever pivots said inboard end of said release lever away from said inboard end of said catch arm such that said catch arm pivots away from the first component so that said catch arm does not brace a portion of the first component between said outboard end of said catch arm and the, and;

a spring continuously biasing said release lever toward said catch arm.

2. The apparatus of claim 1 wherein said inboard end of said release lever has a concave surface matable with a convex surface on said inboard end of said catch arm when said inboard end of said catch arm abuts said inboard end of said release lever.

3. The apparatus of claim 1 wherein said pivotal attachment of said catch arm to said top of said body portion includes a spring biasing said catch arm to pivot away from the first component.

4. The apparatus of claim 1 wherein said outboard end of said catch arm has a concave underside to brace a first component that has a convex surface.

5. An apparatus for removably attaching a first component to an elongate member, said apparatus comprising:

a body portion having a top and a pair of leg members, said leg members adapted to removably receive an elongate member;

a catch arm pivotally attached to said top of said body portion and having an inboard end and an outboard end, a release lever pivotally attached to said top of said body portion and having an inboard end and an outboard end, said catch arm and said release lever configurable in a first position where application of force to said outboard end of said release lever pivots said inboard end of said release lever away from said inboard end of said catch arm such that said catch arm pivots away from the first component so that said catch arm does not brace a portion of the first component between said outboard end of said catch arm and the elongate member, and a second position where application of force to said outboard end of said catch arm pivots said catch arm and said release lever so that said inboard end of said release lever abuts said inboard end of said catch arm and said outboard end of said catch arm braces a portion of the first component against the elongate member, and;

a spring continuously biasing said release lever toward said catch arm.

6. The apparatus of claim 5 wherein said inboard end of said release lever has a concave surface matable with a convex surface on said inboard end of said catch arm when said inboard end of said catch arm abuts said inboard end of said release lever.

7. The apparatus of claim 5 wherein said pivotal attachment of said catch arm to said top of said body portion includes a spring biasing said catch arm to pivot away from the first component.

8. The apparatus of claim 5 wherein said outboard end of said catch arm has a concave underside to brace a first component that has a convex surface.

9. The apparatus of claim 5 wherein said pair of leg members each has an interior side that is concave to mate with an elongate member that has a circular cross-section.

10. The apparatus of claim 9 further comprising a shim between said pair of leg members, said shim having a semi-circular tapered cross-section to mate with an elongate member that has a circular cross-section.

11. An apparatus for removably attaching a first component to a second component, said apparatus comprising:

a body portion having a top and a base, said base adapted to removably attach to the second component;

a catch arm pivotally attached by a spring means to said top of said body portion and having an inboard end and an outboard end, and;

a release lever pivotally attached by a spring means to said top of said body portion and having an inboard end and an outboard end, said catch arm and said release lever configurable in a first position where said inboard end of said release lever abuts said inboard end of said catch arm such that said catch arm braces a portion of the first component between said outboard end of said catch arm and the second component, said catch arm and said release lever further configurable in a second position where application of force to said outboard end of said release lever pivots said inboard end of said release lever away from said inboard end of said catch arm such that said catch arm pivots away from the first component so that said catch arm does not brace a portion of the first component between said outboard end of said catch arm and the second component, said inboard end of said release lever having a concave surface mateable with a convex surface on said inboard end of said catch arm.

12. The apparatus of claim 11 wherein said spring means biases said catch arm to pivot away from the first component.

13. The apparatus of claim 11 wherein said spring means biases said inboard end of said release lever to abut said inboard end of said catch arm.

14. The apparatus of claim 11 wherein said outboard end of said catch arm has a concave underside to brace a first component that has a convex surface.

* * * * *

UNITED STATES PATENT AND TRADEMARK OFFICE

CERTIFICATE OF CORRECTION

PATENT NO. : 5,683,201
DATED : November 4, 1997
INVENTOR(S) : J.P. Gauron

It is certified that error appears in the above-indentified patent and that said Letters Patent is hereby corrected as shown below:

| COLUMN | LINE | ERROR |
|---|---|---|
| Title page | Top of page (under [19]) | "Guaron" should read --Gauron-- |
| [75] Title page | Inventor | "Guaron" should read --Gauron-- |
| 5 (Claim 1, | 7 line 6) | After "end" delete "," and insert therefor--;-- |
| 5 (Claim 1, | 24 line 23) | "and the, and;" should read --and the second component; and-- |
| 5 (Claim 5, | 45 line 7) | After "end" delete "," and insert therefor --;-- |

UNITED STATES PATENT AND TRADEMARK OFFICE

CERTIFICATE OF CORRECTION

PATENT NO. : 5,683,201
DATED : November 4, 1997
INVENTOR(S) : J.P. Gauron

It is certified that error appears in the above-indentified patent and that said Letters Patent is hereby corrected as shown below:

| COLUMN | LINE | ERROR |
|---|---|---|
| 6 (Claim 5, | 2 line 24) | "member, and;" should read --member; and-- |
| 6 (Claim 11, | 30 line 7) | "end, and;" should read --end; and-- |

Signed and Sealed this

Fifth Day of May, 1998

Bruce Lehman

*Attest:*

BRUCE LEHMAN

*Attesting Officer*

*Commissioner of Patents and Trademarks*